United States Patent [19]

Frolov

[11] 4,133,968

[45] Jan. 9, 1979

[54] APPARATUS FOR FORMING SELF-SINTERING ELECTRODES

[76] Inventor: Jury F. Frolov, M. Muranovskaya ulitsa, 11, korpus 1, kv. 29., Moscow, U.S.S.R.

[21] Appl. No.: 800,616

[22] Filed: May 26, 1977

[51] Int. Cl.[2] ..... H05B 7/107

[52] U.S. Cl. ..... 13/18 R

[58] Field of Search ..... 13/9, 14–17, 13/18

[56] References Cited

U.S. PATENT DOCUMENTS

| | | | |
|---|---|---|---|
| 1,150,021 | 8/1915 | Favier | 13/18 |
| 1,640,735 | 8/1927 | Soderberg | 13/18 |
| 3,819,841 | 6/1974 | Persson | 13/18 |

*Primary Examiner*—R. N. Envall, Jr.

*Attorney, Agent, or Firm*—Lackenbach, Lilling & Siegel

[57] ABSTRACT

An apparatus for forming self-sintering electrodes comprises a permanent current-carrying mold for self-sintering electrodes; a charge-feeding tube concentrically disposed within the mold; a power lead; a drive for moving said electrodes, a device for feeding and pressing electrode material; and a supporting cylinder mounted concentrically around the charge-feeding tube, so as to envelope it, the top part of said cylinder being attached to the drive for moving the electrodes and the bottom part supporting the mold. The device for feeding and pressing electrode material is arranged between the charge-feeding tube and the supporting cylinder in the region near their top portions and is attached to a cross beam movable upwards and downwards by means of special mechanisms, e.g. hydraulic cylinders, mounted on the drive for moving the electrodes.

9 Claims, 3 Drawing Figures

APPARATUS FOR FORMING SELF-SINTERING ELECTRODES

FIELD OF THE INVENTION

The present invention relates to the field of electrothermic technology and more particularly, to apparatus for forming self-sintering electrodes. The invention can be used in ferrous and non-ferrous metallurgy, in chemical operations and in other industries where use is made of electric furnaces fitted with self-sintering electrodes.

Further development of electrothermic ore treatment requires new efficient electric furnacess and effectual methods of their use, which would ultimately increase productive output, reduce production costs and create healthier working conditions for the personnel operating the equipment.

DESCRIPTION OF THE PRIOR ART

There is widely known an apparatus, for forming self-sintering electrodes, comprising a permanent current-carrying mold for said electrodes, a charge-feeding tube concentrically positioned inside the mold, a power lead, a drive for moving the electrode, and a device for feeding and pressing electrode material.

The apparatus suffers from substantial disadvantages, among which are the following: the current-carrying mold can only be charged with an electrode material in the form of a liquid pulp, which requires additional energy for heating it outside the apparatus; the internal wall of the mold is stationary relative to the electrode being formed, which requires some additional force to overcome the static friction between the wall and the sintered electrode block for moving it out of the mold as it burns in the furnace; the device for feeding the electrode material and part of the supporting casing are located within the zone of the power lead, which initiates increased power losses caused by the induction of eddy currents within said components with an increase in power and amperage of the furnace and which renders the running and maintenance of the feeding device cumbersome.

SUMMARY OF THE INVENTION

It is, therefore, an object of the present invention to eliminate the above disadvantages.

Another object of the invention is a better use of the heat of gases flowing through the charge-feeding tube.

Still another object of the invention is to improve the conditions for electrode sintering and to upgrade the quality of the electrodes being formed.

A further object of the invention is to facilitate handling of the apparatus.

Another object of the present invention is to increase the reliability of the apparatus.

Still another object of the invention is to provide more efficient feeding of electrode material in the form of large-size blocks.

Finally, the object of the invention is to provide periodical feeding of a charge by specified quantities.

These objects are achieved by an apparatus for forming self-sintering electrodes which has a permanent current-carrying mold, a charge-feeding tube concentrically disposed within the mold, a power lead, a drive for moving the self-sintering electrode and a device for feeding and pressing the electrode material. According to the invention, there is provided a supporting cylinder enveloping the charge-feeding tube and mounted concentrically with it, the cylinder having its top portion secured to said drive for moving the electrode and its bottom portion connected to said current-carrying mold. The device for feeding and pressing the electrode material is mounted in the space between the top portions of said supporting cylinder and said charge-feeding tube and is connected to a cross beam movable upwards and downwards by means of suitable mechanisms, e.g. hydraulic cylinders, which are attached to said drive for moving the electrode.

It is preferable that the device for feeding and pressing electrode material should be made in the form of pivotal cantilevers attached to the cross beam and disposed around the charge-feeding tube, said contilevers being furnished with extensible tapered lock pins, adapted to engage the charge-feeding tube through corresponding seats provided thereon, and with pressure screws, disposed in the annular space between the supporting cylinder and the charge-feeding tube.

It is advantageous that said device should also include an annular piston supporting tubes for feeding electrode material, one end of each of said tubes being mounted on said piston and the other end being mounted on said cross beam.

It is preferable that the tubes for feeding electrode material should be disposed at right angles to a horizontal axis of the apparatus The tubes can also be disposed at an angle to the horizontal axis of the apparatus, the angle ranging preferably from 45° to 85°.

It is also advantageous that, in order to ensure the periodic delivery of charge to the space under the bottom end face of the hollow self-sintering electrode, a vertical shaft be provided which extends concentrically through the charge-feeding tube, said shaft having its top end connected to a drive for its rotation, mounted on a feed bin, and its bottom end connected to a hollow tapered disc rotatable therewith The disc is connected to another hollow tapered disc, rigidly fixed to the charge feeding tube, by means of flexible links secured to both said discs along the peripheries thereof. The vertical shaft also supports an apertured disc situated above another apertured disc built into the feed bin.

An apparatus according to the invention offers the following advantages over apparatus known in the art:

the apparatus makes it possible to use electrode material in a solid as well as in a liquid state for loading and feeding into the permanent current-carrying mold;

it provides for better utilization of the heat of the emerging gases by using this heat for heating the electrode material and sintering the electrode and also for drying and heating the charge;

it allows the emitting gases to be captured, which provides healthier working conditions and better protection of the environment;

it provides for the use of the gases emitted from the furnace and purified gases for feeding through the hole in the electrode back into the furnace, or for use for this purpose of natural gas or other gases;

it ensures the formation of a denser, stronger electrode block with a higher electric conductivity;

it provides an efficient method of feeding the electrode material in the form of annular blocks to be used, which makes it possible to mechanize operation and to increase productive output with fewer personnel;

it fully eliminates metallic inclusions in the electrode, which prevents the contamination of the metal or alloy being produced;

it provides for the continuous or periodic loading and feeding of the charge into the furnace;

it allows the electrode to be sealed in the roof of the furnace and, thus, excludes the leakage of gas into the shop room;

it ensures the displacement and ejection of the electrode from the permanent current-carrying mold with simultaneous retention of the electrode block and movement of the charge, which prevents jamming of the charge and increases the reliability of operation;

it allows the formation of the electrode and its feeding to be fully mechanized and automated; and it provides a 25 to 30% saving of electrode material and the use of up to 25% of small-size grain (under 10 mm) in charge, and reduces power-consumption by 7 to 10%.

BRIEF DESCRIPTION OF THE DRAWINGS

The present invention will be better understood from the following detailed description of embodiments thereof given with reference to the accompanying drawings. In the drawings.

DETAILED DESCRIPTION OF THE INVENTION

Figure 1:
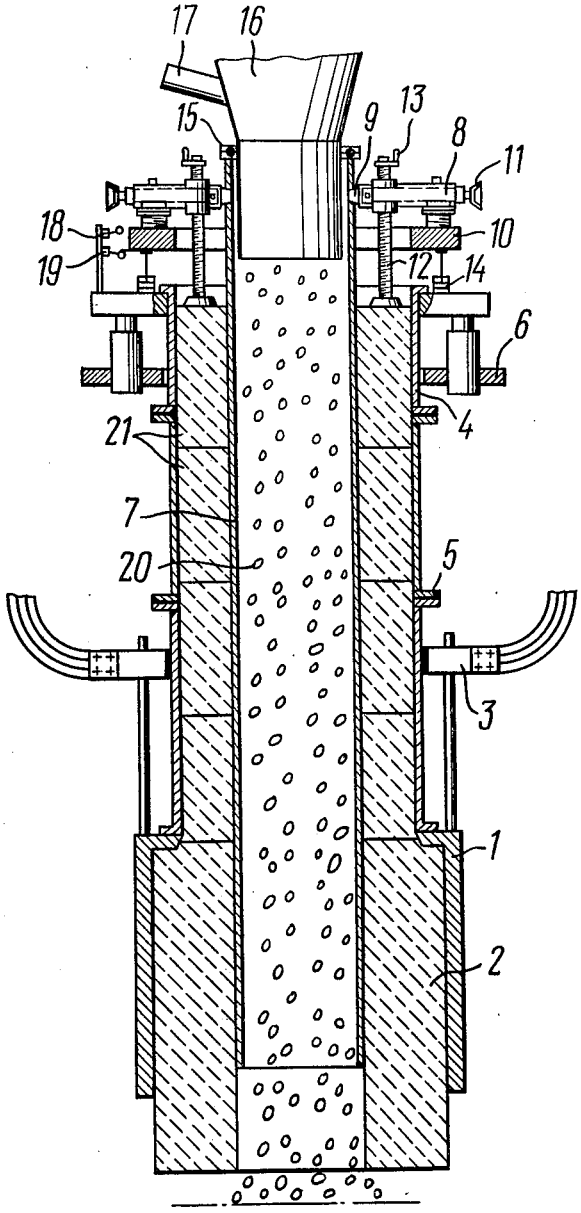
FIG. 1 is an elevational, cross-sectional view of an apparatus featuring a preferred construction of the device for feeding and pressing electrode material, according to the invention.

Referring now to FIG. 1, an apparatus has a permanent current-carrying mold 1 for forming a self-sintering electrode 2, a power lead 3 electrically connected to the current-carrying mold 1 and attached, together therewith, to a supporting cylinder 4 which has several insulation steps 5 along its length. The cylinder 4 has its top attached to a drive 6 for moving the electrode 2. A charge-feeding tube 7 is concentrically positioned through the cylinder 4 and the mold 1.

A device for feeding the pressing electrode material, which may be one of several embodiments, is mounted at the top of the apparatus in a space between the supporting cylinder 4 and the charge-feeding tube 7. According to one embodiment, the device may have pivotal cantilevers 8 with tapered lock pins 9 extendable therethrough which engage the tube 7 through corresponding conical seats provided thereon.

The pivotal cantilevers 8 are attached to a cross beam 10.

The tapered lock pins 9 have screw-threaded portions and are provided with handwheels 11.

The cantilevers 8 support pressure screws 12 provided with hand-wheels 13. The cross beam 10 is connected to double-acting power cylinders 14 which are mounted on the drive 6 for moving the electrode 2.

The topmost part of the charge-feeding tube 7 includes a seal 15 of any conventional type (pneumatic seal, stuffing box, etc.) for securely sealing the gap between the tube 7 and the extensible pipe of a feed bin 16 which has a gas duct 17 built into it. The extreme upper and lower positions of the cross beam 10 are controlled by limit switches 18 and 19, respectively.

The apparatus operates as follows.

Initially, the charge-feeding tube 7 is brought to its lowermost position, and a temporary blind flange of a sheet material (e.g. steel) is attached to the bottom end face of the tube by any method, such as welding, etc.

At the bottom, the flange extends to the edge of the mold 1 and closes the annular space between the mold and the tube 7 wherein the self-sintering electrode 2 is formed. As the flange is used as a temporary auxiliary element only during the initial stage of operation, it is not shown in the drawings.

The apparatus is lowered by means of the drive 6 so that the distance between the flange or the end face of the mold 1 and the furnace hearth is about 150 to 200 mm.

The first specified batch of charge 20, in the form of a current-conductive carbonic material (coke, for instance), is then delivered from the feed bin 16 to the space under the end face of the hollow self-sintering electrode 2 to be produced. The coke fills the space between the neighbouring electrodes in the furnace melting chamber, whenever a three-phase system is used, thereby creating a circuit through which electric current can flow.

Whenever a single-phae system is used, the circuit is formed by connecting the hearth to one of the poles of the power supply.

The lumps of electrode material are then charged by hand, or otherwise, into the space between the mold and the tube 7, thereby forming the body of the hollow self-sintering electrode 2. Some of the electrode material is charged to fill a part of the annular space between the tube 7 and the cylinder 4.

Further, the electrode material in the form of blocks 21 is placed into the vacant annular space by means of any suitable hoisting equipment (electric hoist, for instance).

To carry out the aforedescribed operation in the start-up stage and afterwards, while the furnace is running, the feed bin 16 along with the gas duct 17, telescopically connected with its extension in a vertical plane (not shown), is lifted clear of the space above the seal 15 and the tube 7. The pressure screws 12 are then brought to their uppermost positions above the level of the cross beam 10 by turning the handwheels 13, whereupon the tapered lock pins 9 are retracted to their initial positions by handwheels 11, thereby releasing the tube 7.

The pivotal cantilevers 8 are then swung in any direction suitable to the operator to provide access from above to the annular space between the charge-feeding tube 7, the cross beam 10, and the supporting cylinder 4.

The cross beam 10 is lifted by the double-acting power cylinders 14 to the topmost position determined by the limit switch 18.

The blocks 21 are loaded in succession until the upper face of the top block is level with the upper end face of the supporting cylinder 4 or slightly juts out above it. As is done at the start-up stage, the pivotal cantilevers 8 are brought to the initial position, and the pressure screws 12 are brought down by turning the handwheels 13 until they bear against the face of the upper block 21 of the electrode material. The cross beam 10 is moved downwards by the power cylinders 14, and the pressure screws 12 drive down the upper block 21 which, acting as a piston, compresses and pushes down the underlying mass of the electrode material. The lowermost position of the cross beam 10 is determined by the limit switch 19. The lock pins 9 are then advanced by operating handwheels 11 to engage the corresponding conical seats on the tube 7.

Thereafter, the charge-feeding tube 7 is moved upwards and downwards together with cantilevers 8 to feed down the blocks 21 of the electrode material and the electrode 2. The feed bin 16 with the gas duct 17 is returned to the initial position.

The power supply is switched on and electric current flows in the closed circuit formed by the power lead 3, the current-carrying mold 1, the flange, and the coke.

That causes the heating of the flange, the coke, and the electrode material and gradually creates the necessary temperature conditions for the self-sintering electrode 2 to form.

As the temperature of electrode coking (350° to 400° and over) is reached from the electrode end face upwards along the electrode length, the electrode material undergoes transformation into a solid electroconductive electrode block.

By this moment, the blind flange burns up having fulfilled its function.

The loading of the blocks 21 of the electrode material during the normal run of the apparatus differs from the initial loading described above in that the charge-feeding tube 7 together with the pivotal cantilevers 8 and the cross beam 10 is lifted to the extreme upper position determined by the limit switch 18, and the cantilevers 8 are swung to clear the annular space for the blocks 21. After the loading, the tube 7 is engaged by the cantilevers 8 and is used along with the pressure screws 12 carried thereon as a pusher to eject the sintered hollow electrode 2 from the mold 1.

The double-acting power cylinders 14 move upwards and downwards the cross beam 10 which carries the pivotal cantilevers 8 with the pressure screws 12 and (through the tapered lock pins 9) the tube 7. The upward stroke of this system covers the full distance between the limit switches 19 and 18 and the downward stroke may be carried out intermittently at a speed equal or proportional to the rate of coking, movement (ejection from the mold 1) and burning in the furnace of the hollow electrode 2. That is effected with the aid of a programmable control unit which is fed with inputs provided therefore by, for example, temperature sensors (not shown in FIG. 1) placed in the coking zone inside the mold 1.

As the whole system moves upwards, the charge-feeding tube 7 breaks contact with the sintered electrode block and moves upwards relative thereto, at the same time moving relative to charge 20, which comes down continuously or by batches from the feed bin 16. The charge 20 is thereby shaken down relative to the internal surface of the tube 7, which fully prevents therein jamming therein.

The hollow electrode 2 is moved in the furnace (upwards and downwards) by means of the drive 6 with regard to the specified electrical conditions of furnace operation.

The gas emerging in the furnace rises along the tube 7 heating the charge 20 and, through the tube's wall, the electrode material (including the blocks 21), which provides better utilization of the gas heat.

The gas escape to the atmosphere is prevented by the seal 15, the gas itself being removed through the gas duct 17.

Gas can be blown in through the tube 7 and charge 20 from above; for this purpose there can be used the furnace gas removed through a duct in the furnace roof, natural gas, etc.

Another embodiment of the present invention with a different device for feeding and pressing electrode material is arranged as follows.

Figure 2:
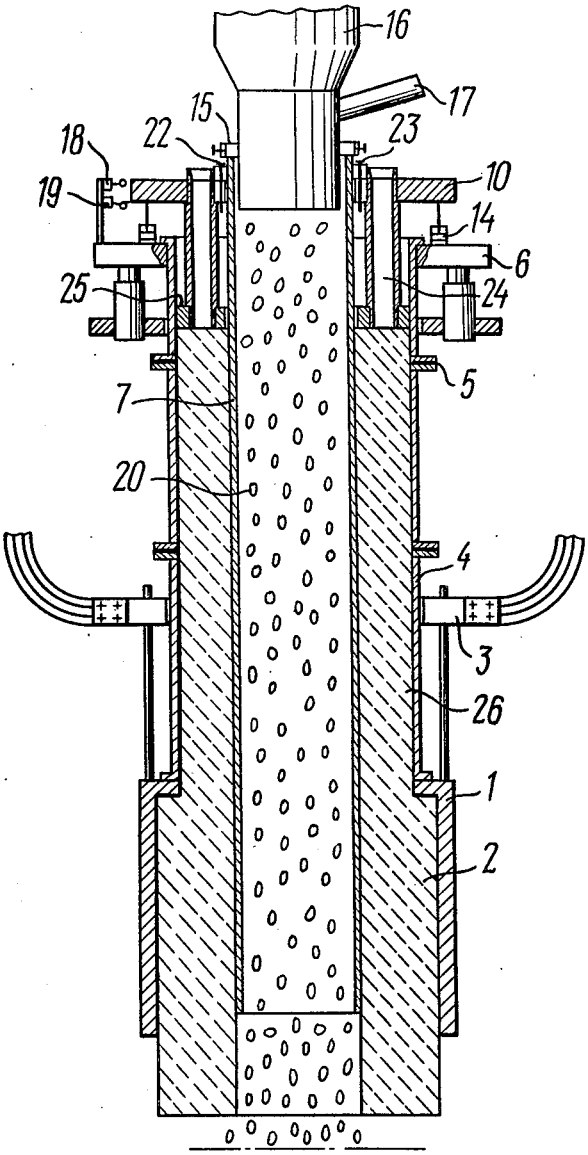
FIG. 2 is an elevational, cross-sectional view of another embodiment of the apparatus featuring an alternative construction of said device, according to the invention.

A charge feeding tube 7 (see FIG. 2) is hingedly jointed through brackets 22 with screw jacks 23 which are built into a cross beam 10. Charge 20 is delivered to the tube 7 from a feed bin 16. Tubes 24 for the delivery of electrode material are fixed in a cross beam 10. An annular piston 25 connected to the ends of the tubes 24 is placed in the annular space between the supporting cylinder 4 and the tube 7. The cross beam 10, supporting the other ends of the tubes 24, is moved upwards and downwards by means of double-acting power cylinders 14, which are mounted on a drive 6 for moving an electrode 2. The tubes 24 may be disposed vertically, i.e. at right angles to a horizontal axis of the apparatus, or at an angle ranging from 45° to 85° to the horizontal axis, depending on the size of the annular space (i.e. the electrode diameter) and of the tubes themselves, and also on the load to be exerted on electrode material. This second arrangement of the tubes 24 provides for more uniform distribution of the electrode material fed therethrough to the annular space between the cylinder 4 and the tube 7 and for more uniformly distributed pressure of the piston 25 on the mass of the electrode material. With smaller angles between the tubes 24 and the apparatus horizontal axis, the rigidity of the construction can be ensured by auxiliary means, such as stiffening plates, braces, etc.

The apparatus in the form just described operates as follows.

First, the charge-feeding tube 7 is brought by means of the screw jacks 23 into the extreme lower position enable to attachment thereto of a temporary blind flange of sheet material (e.g. steel) using any known method, such as welding, etc. The tube 7 is then lifted by the screw jacks 23 until the flange contacts the face of the bottom end of the mold 1, thereby closing the annular space between the tube 7 and the mold 1 wherein the hollow self-sintering electrode 2 is formed. A first specified batch of charge 20 in the form of a current-conductive carbonic material (e.g. coke) is then delivered from the feed bin 16 through the charge-feeding tube 7 to the space under the end face of the hollow self-sintering electrode 2 to be produced. The coke fills the space between the neighbouring electrodes in the furnace melting chamber, thereby creating a circuit through which electric current can flow.

Electrode material 26 is loaded by any known method through the tubes 24 to fill the annular space of the mold, where the electrode 2 is formed, and the annular space between the supporting cylinder 4 and the tube 7. The electrode material may partly fill the tubes 24 as well. The power supply is then switched on, and electric current flows through the closed circuit formed by the power lead 3, the current-carrying mold 1, flange, and the coke. The flange, the coke, and the electrode material are thus heated, thereby creating the necessary conditions for the formation of the hollow self-sintering electrode 2.

As the temperature of electrode coking (350° to 400° and over) is reached from the electrode end face upwards along the electrode length, the electrode material undergoes transformation into a solid electroconductive electrode block. By this moment, the blind flange burns up having fulfilled its function.

The power cylinders 14 are actuated automatically or by the operator through remote control, and the cross beam 10 is thereby moved along with the tubes 24 and the annular piston 25 from the upper position determined by the limit switch 18 to the lower position determined by the limit switch 19, whereupon the piston 25 is automatically returned by the power cylinders 14 to the initial upper position.

While the annular piston 25 is moving down, it forces the electrode material 26 into the mold 1 and ejects the sintered electrode 2 from the mould to compensate for its burning in the furnace.

The tube 7 moves down together with the piston 25 and the electrode material 26, driven by the power cylinders 14 through the cross beam 10 and the screw jacks 23 now serving as pull rods. The tube 7 is at this moment used as a pusher to help move the sintered electrode 2 out of the mold 1.

Driven upwards under the action of the power cylinders 14, the charge-feeding tube 7 breaks contact with the sintered electrode block and moves upwards relative thereto, at the same time moving relative to the charge 20 which is fed down continuously from the feed bin 16. The charge 20 is thereby shaken down, which fully prevents jamming in the tube 7.

The gas emitted from the furnace rises along the tube 7, thereby heating the charge 20 and, through the tube's wall, the electrode material 26, which makes for better utilization of the gas heat. Leakage of the gas from the tube 7 to the atmosphere is prevented by a seal 15, the gas itself being removed through a gas duct 17.

This arrangement of the apparatus also makes it possible to blow gas in through the tube 7 and charge 20 from above; for this purpose there can be used the furnace gas removed through a duct in the furnace roof, natural gas, etc.

During a normal run of the smelting process, normal coking (sintering) conditions and normal feeding-down of the hollow self-sintering electrode 2 for compensation as it burns, the charge-feeding tube 7 maintains a practically constant optimal position inside the mold 1, which can be adjusted with the aid of the screw jacks 23.

To regulate the power fed to the furnace by specified electric parameters (amperage and voltage), the whole system is moved down along with the electrode 2 by means of the drive 6, controlled by any known type of automatic power regulator.

The drive 6 can be hydraulic (as shown in the drawings), electromechanical (screw of cable type), or of any other known type. The current-carrying mold 1 is made of copper or one of its allys, and the charge-feeding tube 7 is made of high-temperature steel or of a water-cooled casting.

Some processes require a periodic delivery of charge to the space under the lower end face of the electrode by specified quantities rather than a constant flow of charge as described above.

Figure 3:
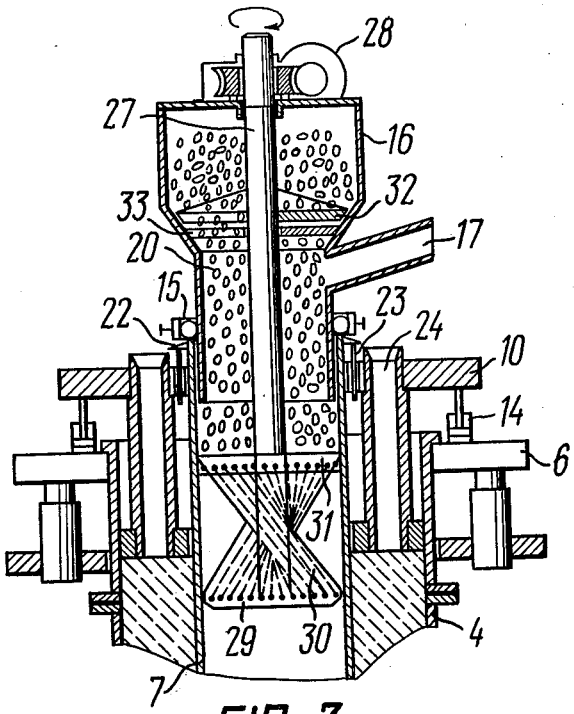
FIG. 3 is an elevational, partly in section, view of another embodiment of the apparatus with a device for the periodic delivery of charge in specified quantities.

To effect that, the apparatus is provided with a vertical shaft 27 (see FIG. 3) which is concentrically built into the charge-feeding tube 7. The upper end of the shaft 27 is connected for rotation to a drive 28 (e.g. of the worm-gearing type) which is mounted on a feed bin 16. The lower end of the shaft 27 is connected (e.g. through spokes, which are not shown in the drawing) to a hollow tapered disc 29 rotatable with the shaft, which is connected to a hollow tapered disc 31, rigidly fixed to the charge-feeding tube 7, by means of flexible links 30 secured to both said discs along the peripheries thereof.

In addition, the vertical shaft 27 carries a flat apertured disc 32 situated above another flat apertured disc 33 which is built into the feed bin 16 and is stationary.

The apparatus in the embodiment described above operates as follows.

When a batch of charge 20 is to be delivered to the space under the lower end face of the electrode 2, the drive 28 is started, thereby turning the shaft 27 counterclockwise through the angle necessary for the flexible links 30 to straighten out vertically (this angle of rotation can be closely controlled by a conventional cam-type controller coupled with the drive 28 or by limit switches).

As this takes place, a clear passage is formed between the shaft 27 and the flexible links 30 through which the charge 20 comes down. The main bulk of the charge 20 in the feed bin 16 is now blocked therein because the flat apertured disc 32 has turned with the shaft 27 and has closed by its blind portions the corresponding openings (holes) in the apertured disc 33. The gas bursting from the furnace chamber into the charge-feeding tube 7 during the feeding of charge 20 is removed therefrom through a gas duct 17. It is also possible to create a counterpressure to this gas by blowing in a backward flow of some gas, e.g. nitrogen, the furnace gas, etc., through the gas duct 17. Once the batch of charge 20 has been fed in, the drive 28 brings the vertical shaft into its initial position. Here, the discs 32 and 33 let the next batch of charge 20 pass from the feed bin 16 through their superinposed openings (holes) down into the space limited by the flexible links 30.

As the flexible links 30 wind or unwind during rotation of the shaft 27, they cause its displacement in a vertical direction.

This displacement, though small in extent, is taken into account by the provision of an adequate clearance between the discs 32 and 33 and also by the introduction of a splined coupling of the shaft 27 with a corresonding mating part of the drive 28, e.g. the hub of the worm-wheel.

What is claimed is:

1. An apparatus for forming self-sintering electrodes, comprising a permanent current-carrying mold for forming a self-sintering electrode; a charge-feeding tube concentrically disposed within said mold; a power lead electrically connected to the mold; a drive for moving said self-sintering electrode; a device for feeding and pressing electrode material; a supporting cylinder enveloping said charge-feeding tube and mounted concentrically therewith, said cylinder having a top part attached to said drive for electrode movement and a bottom part connected to said mold, said device for feeding and pressing electrode material being located in a space between top portions of said supporting cylinder and said charge-feeding tube and being attached to a cross beam; and means for moving said cross beam upwards and downwards mounted on said drive for moving said electrode.

2. An apparatus according to claim 1, wherein said device for feeding and pressing electrode material comprises pivital cantilevers, mounted on said cross beam around said charge-feeding tube and provided with extensible tapered lock pins engageable with corresponding seats provided on said charge-feeding tube, said pressure screws arranged in an annular space between the supporting cylinder and the charge-feeding tube.

3. An apparatus according to claim 1, wherein said device for feeding and pressing electrode material comprises an annular piston and tubes for feeding said electrode material, one end of each of said tubes being built in said annular piston and another end thereof being secured to said cross beam.

4. An apparatus according to claim 3, wherein said tubes for feeding electrode material are disposed at right angles to a horizontal axis off the apparatus.

5. An apparatus according to claim 3, characterized in that said tubes for feeding electrode material are disposed at an angle of 45° to 85° to the horizontal axis of the apparatus.

6. An apparatus according to claim 3, further comprising, for the periodic delivery of charge to the space under the bottom end face of the self-sintering electrode, a vertical shaft extending concentrically through the charge-feeding tube; a drive for rotating said shaft mounted on a feed bin and connected to a top portion of said shaft; a first hollow tapered disc connected to a bottom portion of said shaft and being rotatable with said shaft; a second hollow tapered disc rigidly fixed to the charge-feeding tube and connected to said first hollow tapered disc by means of flexible links secured to the peripheries of said discs; a first apertured disc mounted on said shaft; and a second apertured disc mounted on said feed bin and positioned below said first apertured disc.

7. An apparatus according to claim 4, further comprising, for the periodic delivery of charge to the space under the bottom end face of the self-sintering electrode, a vertical shaft extending concentrically through the charge-feeding tube; a drive for rotating said shaft mounted on a feed bin and connected to a top portion of said shaft; a first hollow tapered disc connected to a bottom portion of said shaft and being rotatable with said shaft; a second hollow tapered disc rigidly fixed to the charge-feeding tube and connected to said first hollow tapered disc by means of flexible links secured to the peripheries of said discs; a first apertured disc mounted on said shaft; and a second apertured disc mounted on said feed bin and positioned below said first apertured disc.

8. An apparatus according to claim 5, further comprising, for the periodic delivery of charge to the space under the bottom end face of the self-sintering electrode, a vertical shaft extending concentrically through the charge-feeding tube; a drive for rotating said shaft mounted on a feed bin and connected to a top portion of said shaft; a first hollow tapered disc connected to a bottom portion of said shaft and being rotatable with said shaft; a second hollow tapered disc rigidly fixed to the charge-feeding tube and connected to said first hollow tapered disc by means of flexible links secured to the peripheries of said discs; a first apertured disc mounted on said shaft; and a second apertured disc mounted on said feed bin and positioned below said first apertured disc.

9. An apparatus according to claim 1, wherein said means for moving said cross beam are hydraulic cylinders.

* * * * *